US005178984A

United States Patent [19]

Nagatsuka et al.

[11] Patent Number: 5,178,984

[45] Date of Patent: Jan. 12, 1993

[54] ELECTROPHOTOGRAPHIC TONER

[75] Inventors: Ikutaroh Nagatsuka; Atuhiko Eguchi; Takayoshi Aoki, all of Kanagawa, Japan

[73] Assignee: Fuji Xerox Co., Ltd., Tokyo, Japan

[21] Appl. No.: 757,883

[22] Filed: Sep. 11, 1991

[30] Foreign Application Priority Data

Sep. 17, 1990 [JP] Japan ..... 2-243784

[51] Int. Cl.[5] ..... G03G 9/097

[52] U.S. Cl. ..... 430/110; 430/107

[58] Field of Search ..... 430/110, 106, 123, 106.6, 430/107

[56] References Cited

U.S. PATENT DOCUMENTS 4,640,882 2/1987 Mitsuhashi et al. ..... 430/126

4,680,245 7/1987 Suematsu et al. ..... 430/110

4,902,598 2/1990 Winnik et al. ..... 430/110

*Primary Examiner*—John Goodrow

*Attorney, Agent, or Firm*—Finnegan, Henderson, Farabow, Garrett and Dunner

[57] ABSTRACT

A positively chargeable electrophotographic toner is disclosed, which is prepared by adding to toner particles silica fine particles having been surface treated with a homo-or copolymer comprising, as a monomer component, a dialkylaminoalkyl acrylate or a dialkylaminoalkyl methacrylate in the form of a quaternary ammonium salt. The toner has improved fluidity and improved anti-caking properties while exhibiting satisfactory charging properties and environmental stability and causing no image defects.

10 Claims, No Drawings

ELECTROPHOTOGRAPHIC TONER

FIELD OF THE INVENTION

This invention relates to a positively chargeable toner for developing an electrostatic latent image in electrophotography, electrostatic recording, etc.

BACKGROUND OF THE INVENTION

In electrophotography, an electrostatic latent image formed on a photoreceptor is generally developed with a toner containing a pigment, etc., and the resulting toner image is transferred to a transfer sheet and fixed thereon by a hot roll, etc. The photoreceptor is subjected to cleaning for formation of a next electrostatic latent image.

Dry developers used in electrophotography, etc. are divided into one-component developers solely composed of a toner comprising a binder resin having dispersed therein a colorant and two-component developers composed of such a toner and a carrier. In order that these developers have process suitability in copying, they are required to be excellent in fluidity, anti-caking properties, fixability, chargeability, cleaning properties, etc. To improve these properties, particularly fluidity and anti-caking properties, inorganic fine particles are frequently added to a toner.

However, these fine particles have considerable influences on charging properties. For example, generally employed silica type fine particles have strong negative polarity, which seriously reduces chargeability of positively chargeable toners, and also cause great variations of chargeability with environmental changes between summer and winter, often resulting in background fog and insufficient density reproduction.

Dispersibility of the inorganic fine particles also has great influences on toner characteristics. Particles of poor dispersibility tend to fail to obtain desired effects of improving fluidity and anti-caking properties or tend to cause adhesion of toner particles to a photoreceptor due to insufficient cleaning, resulting in image defects such as black spots.

In order to overcome these problems, it has been proposed to use surface-treated inorganic fine particles. Examples of surface-treated inorganic fine particles so far proposed for positively chargeable toners include silica treated with a charge control agent capable of controlling charge polarity of toners to positive (see JP-A-55-135854 (the term "JP-A" as used herein means an "unexamined published Japanese patent application")); silica fine particles treated with a quaternary ammonium salt (see JP-A-63-143562); inorganic particles having thereon a silicone rubber having an amino group or a hardened product thereof (see JP-A-63-155149); inorganic fine particles treated with an amino compound after having been rendered hydrophobic (see JP-A-63-155152); and inorganic fine particles treated with polysiloxane containing an ammonium salt as a functional group (see JP-A-1-123252).

Any of the toners using these treated inorganic fine particles nevertheless has its own merits and demerits. Taking, for instance, the silica particles disclosed in JP-A-55-135854 supra, since the charge control agent used is a dye, it colors the silica powder, making application to color toners difficult. None of the others satisfies all the characteristics required.

SUMMARY OF THE INVENTION

An object of this invention is to provide a positively chargeable toner for electrophotography which is excellent in fluidity and anti-caking properties.

Another object of this invention is to provide a positively chargeable toner for electrophotography which is excellent in chargeability and environmental stability.

A further object of this invention is to provide a toner hardly causing image defects such as black spots.

The above objects of the present invention are accomplished by using silica fine particles having been surface treated with a homo- or copolymer comprising, as a monomer component, a dialkylaminoalkyl acrylate or a dialkylaminoalkyl methacrylate in the form of a quaternary ammonium salt.

That is, in the positively chargeable electrophotographic toner of the present invention which is prepared by adding to toner particles silica fine particles having been surface treated with a specific resin having a quaternary ammonium salt structure, since the charge polarity of silica fine particles is equal to that of toner particles and is treated with resin, silica fine particles have a strong affinity for toner particles. Further, since the surface treated silica fine particles are uniformly dispersed on the surface of toner particles, resin hardly liberates from the toner. Therefore, the toner of the present invention is capable of maintaining the characteristics for a long time.

The surface of the silica fine particles to be treated may have been rendered hydrophobic.

DETAILED DESCRIPTION OF THE INVENTION

The surface-treated silica fine particles which can be added to toner particles have a primary particle diameter of preferably not more than 40 nm, more preferably 0.1 to 20 nm, and most preferably 3 to 16 nm.

The homo- or copolymer comprising a dialkylaminoalkyl acrylate or methacrylate (hereinafter simply referred to as dialkylaminoalkyl (meth)acrylate) in the form of a quaternary ammonium salt (hereinafter simply referred to as a homo- or copolymer having a quaternary ammonium salt structure) can be produced by known processes. Other monomers copolymerizable with a dialkylaminoalkyl (meth)acrylate to be used in production of the copolymers include acrylic acid, acrylic esters, methacrylic acid, methacrylic esters, styrene, and vinyl acetate. In production of the copolymers, a dialkylaminoalkyl (meth)acrylate component preferably ranges from 5 wt % or more, particularly 10 wt % or more, in view of the positive charge control properties of silica fine particles.

Specific examples of the dialkylaminoalkyl (meth)acrylate are dimethylaminoethyl (meth)acrylate, diethylaminoethyl (meth)acrylate, dipropylaminoethyl (meth)acrylate, and dibutylaminoethyl (meth)acrylate.

The dialkylaminoalkyl (meth)acrylate, either alone or in combination of one or more of the other copolymerizable monomers, is polymerized in the presence of a polymerization initiator, and the resulting homo- or copolymer is then quaternarized with, for example, an alkyl benzenesulfonate (e.g., methyl benzenesulfonate) or an alkyl p-toluenesulfonate (e.g., methyl p-toluenesulfonate) to obtain a homo- or copolymer having a quaternary ammonium salt structure.

The homo- or copolymer comprising a dialkylaminoalkyl (meth)acrylate preferably has a weight-average molecular weight of 1,000 to 20,000, particularly 2,000 to 10,000.

The homo- or copolymer having a quaternary ammonium salt structure is used in an amount of from 0.1 to 300%, and preferably from 0.5 to 150%, by weight based on silica fine particles.

Treatment of silica fine particles with the above-described specific polymer is generally carried out by a process comprising dissolving the polymer in an appropriate solvent, adding the solution to silica fine particles to coat the surface thereof, and drying the treated particles to remove the solvent. The treatment is preferably effected by use of a kneader coater, a spray drier, a thermal processor, a fluidized bed apparatus, etc. If desired, the dried particles may be ground and classified.

Solvents used in the treatment include aromatic hydrocarbons, e.g., benzene, toluene, xylene, and chlorobenzene, ketones, e.g., acetone, and 2-butanone, aliphatic hydrocarbon halides, e.g., methylene chloride, chloroform, and ethylene chloride, and cyclic or linear ethers, e.g., tetrahydrofuran, and ethylether, and these may be used alone or in combination of two or more.

Silica fine particles which can be used in the present invention may be previously rendered hydrophobic with an agent imparting hydrophobic properties, such as silane coupling agents. The treatment for rendering silica fine particles hydrophobic may be carried out by using the homo- or copolymer having a quaternary ammonium salt structure in combination with the agent imparting hydrophobic properties.

Specific examples of usable agents for imparting hydrophobic properties include alkylchlorosilanes, e.g., methyltrichlorosilane, octyltrichlorosilane, and dimethyldichlorosilane; alkylmethoxysilanes, e.g., dimethyldimethoxysilane and octyltrimethoxysilane; hexamethyldisilazane; and silicone oil.

Known toner particles mainly comprising a binder resin and a colorant can be used in the present invention.

Binder resins to be used in the toner include homo- or copolymers of styrene or derivatives thereof, e.g., chlorostyrene; monoolefins, e.g., ethylene, propylene, butylene, and isoprene; vinyl esters, e.g., vinyl acetate, vinyl propionate, vinyl benzoate, and vinyl butyrate; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and- vinyl isopropenyl ketone. Particularly useful binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. In addition, polyester resins, polyurethane resins, epoxy resins, silicone resins, polyamide resins, modified rosin, and paraffin waxes can also be used.

Colorants which can be used in the toner typically include carbon black, nigrosine dyes, Aniline Blue, Charchoyl Blue, chrome yellow, ultramarine blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

If desired, the toner particles may further contain known additives such as a charge control agent. Specific examples of the charge control agent include positive charge control agents, e.g., nigrosine dyes, quaternary ammonium salts, pyridinium salts, and phosphonium salts.

The toner particles may be either a magnetic toner containing therein a magnetic substance or a capsule toner.

The toner particles usually have an average particle size of from 3 to 20 μm.

Adhesion of the surface-treated silica fine particles to the toner particles can be carried out by mixing toner particles with the silica fine particles in, e.g., a twin-cylinder mixer and a Henschel mixer. The amount of the surface-treated silica fine particles to be added preferably ranges from 0.05 to 20% by weight, and more preferably from 0.1 to 5.0% by weight, based on the total toner weight.

Adhesion of the surface-treated silica fine particles to the surface of the toner particles may be mere mechanical adhesion or loose fixing to the surface. Further, the adhesion may be over the entire surface or part of the surface of the toner particles. The surface-treated silica fine particles may be adhered partly in the form of agglomerates, but is preferably adhered in the form of a single-layer particle.

The thus prepared electrophotographic toner of the present invention can be used either as a one-component developer as such or as a two-component developer in combination with a carrier.

Where the toner of the present invention is used as a two-component developer, the surface-treated silica fine particles may be added to a mixed system of a toner and a carrier to conduct coating of the toner particles simultaneously with the toner/carrier mixing.

The carrier used in the two-component developers includes iron powder, glass beads, ferrite powder, nickel powder, and these powders having thereon a resin coating.

The present invention is now illustrated in greater detail with reference to Examples, but it should be understood that the present invention is not deemed to be limited thereto. All the parts, percents and ratios are by weight unless otherwise indicated.

Preparation of Surface-Treated Silica Fine Particles A

| | |
|---|---|
| Resin prepared by quaternarizing dimethylaminoethyl methacrylate/butyl acrylate/styrene copolymer (15/15/70; molecular weight: 9000) with methyl p-toluenesulfonate | 10 parts |
| Acetone | 1000 parts |
| Hydrophobic silica ("R972" produced by Nippon Aerosil K.K; particle size: 16 nm) | 100 parts |

The above components were thoroughly mixed, dissolved, and dispersed. The solvent was removed on a fluidized bed to obtain surface-treated silica fine particles A.

Preparation of Surface-Treated Silica Fine Particles B

| | |
|---|---|
| Resin prepared by quaternarizing diethylaminoethyl methacrylate/methyl methacrylate/copolymer (40/60; molecular weight: 10000) | 5 parts |

-continued

| | |
|---|---|
| with methyl p-toluenesulfonate | |
| Acetone | 500 parts |
| Hydrophobic silica "R972" (particle size: 16 nm) | 100 parts |

The above components were thoroughly mixed, dissolved, and dispersed. The solvent was removed on a fluidized bed to obtain surface-treated silica fine particles B.

Preparation of Surface-Treated Silica Fine Particles C

| | |
|---|---|
| Triethylamine p-toluenesulfonate | 5 parts |
| Acetone | 500 parts |
| Hydrophobic silica "R972" | 100 parts |

The above components were thoroughly dissolved and mixed. After removing the solvent in a thermal processor, the mixture was ground to obtain surface-treated silica fine particles C.

Preparation of Surface-Treated Silica Fine Particles D

| | |
|---|---|
| Nigrosine | 10 parts |
| Methyl ethyl ketone | 500 parts |
| Hydrophobic silica "R972" | 100 parts |

The above components were thoroughly dissolved, mixed and filtrated. After removing the solvent in a vacuum dryer, the mixture was ground to obtain surface-treated silica fine particles D.

Preparation of Surface-Treated Silica Fine Particles E

| | |
|---|---|
| Tetradecyldimethylbenzyl ammoniumchloride | 10 parts |
| Hydrophobic silica "R972" | 100 parts |

The above components were thoroughly dissolved in 500 parts of purified water and mixed. After removing the solvent in a vacuum dryer, the mixture was ground to obtain surface-treated silica fine particles E.

Preparation of Surface-Treated Silica Fine Particles F

| | |
|---|---|
| N-trimethoxysilylpropylimidazole | 5 parts |
| Isopropyl alcohol | 500 parts |
| Hydrophobic silica "R972" | 100 parts |

The above components were thoroughly dissolved and mixed. After removing the solvent in a thermal processor, the mixture was ground to obtain surface-treated silica fine particles F.

Preparation of Toner Particles

| | |
|---|---|
| Styrene-butyl acrylate copolymer (80/20) ($\overline{Mw} = 1.41 \times 10^5$, $\overline{Mn} = 3.35 \times 10^3$) | 100 parts |
| Carbon black ("REGAL 330" produced by Cabot) | 10 parts |
| Polypropylene wax ("VISCOL 660P" produced by Sanyo Kasei K.K.) | 5 parts |

The above components were melt-kneaded in a Banbury mixer, cooled, and pulverized in a jet mill. The particles were classified by means of a classifier to obtain toner particles having an average particle diameter of 11 μm.

EXAMPLE 1

One part of surface-treated silica fine particles A and 100 parts of the above-prepared toner particles were mixed and dispersed in a Henschel mixer to prepare a toner.

EXAMPLE 2

One part of surface-treated silica fine particles B and parts of the above-prepared toner particles were mixed and dispersed in a Henschel mixer to prepare a toner.

COMPARATIVE EXAMPLE 1

One part of hydrophobic silica "R972" and 100 parts of the above-prepared toner particles were mixed and dispersed in a Henschel mixer to prepare a toner.

COMPARATIVE EXAMPLE 2

One part of surface-treated silica fine particles C and parts of the above-prepared toner particles were mixed and dispersed in a Henschel mixer to prepare a toner.

COMPARATIVE EXAMPLE 3

One part of surface-treated silica fine particles D and 10 parts of the above-prepared toner particles were mixed and dispersed in a Henschel mixer to prepare a toner.

COMPARATIVE EXAMPLE 4

One part of surface-treated silica fine particles E and 100 parts of the above-prepared toner particles were mixed and dispersed in a Henschel mixer to prepare a toner.

COMPARATIVE EXAMPLE 5

One part of surface-treated silica fine particles F and 100 parts of the above-prepared toner particles were mixed and dispersed in a Henschel mixer to prepare a toner.

Preparation of Developer Composition

A developer composition was prepared by mixing 5 parts of each of the toners prepared in Examples 1 and 2 and Comparative Examples 1 to 5 with 95 parts of a magnetic powder-dispersed type carrier (average particle diameter: 45 μm) which was prepared by melt-kneading 30 parts of a styrene-butyl acrylate copolymer (75/25) ($\overline{Mw}=1.10\times10^5$, $\overline{Mn}=8.05\times10^3$) and 70 parts of a magnetic powder ("EPT-1000" produced by Toda Kogyo K.K.), grinding the blend, followed by classification.

Copying Test

Continuous copying test was carried out using the resulting developer and an electrophotographic copying machine ("FX-5075" manufactured by Fuji Xerox Co.). In the initial stage of running and after obtaining 100,000 copies, the charge quantity of the developer was measured with a blow-off measuring apparatus, and the solid image density and background fog were measured with a Macbeth densitometer. The image quality was also observed with eyes. General evaluation was made according to whether there was no problem (acceptable) or image defects occurred (unacceptable). The results obtained are shown in Table 1 below.

TABLE 1

| Example No. | Initial Stage Charge Quantity (μC/g) | Initial Stage Solid Density | Initial Stage Back-ground Fog | After 100,000 Copies Charge Quantity (μC/g) | After 100,000 Copies Solid Density | After 100,000 Copies Back-ground Fog | Image Quality | General Evaluation |
|---|---|---|---|---|---|---|---|---|
| Example 1 | 22.0 | 1.38 | 0.00 | 24.2 | 1.30 | 0.0 | No problem | Acceptable |
| Example 2 | 23.2 | 1.35 | 0.00 | 17.8 | 1.42 | 0.00 | No problem | Acceptable |
| Comparative Example 1 | 5.2 | 1.48 | 0.08 | −2.5 | 0.48 | 0.21 | Fog occurred from the initial stage | Unacceptable |
| Comparative Example 2 | 25.0 | 1.40 | 0.00 | 8.3 | 1.08 | 0.11 | Fog occurred after obtaining 100,000 copies | Unacceptable |
| Comparative Example 3 | 25.8 | 1.36 | 0.00 | 10.1 | 1.12 | 0.12 | Fog occurred after obtaining 100,000 copies | Unacceptable |
| Comparative Example 4 | 25.1 | 1.41 | 0.00 | 8.5 | 1.02 | 0.10 | Fog occurred after obtaining 100,000 copies | Unacceptable |
| Comparative Example 5 | 23.7 | 1.39 | 0.00 | 6.9 | 0.82 | 0.28 | Fog occurred after obtaining 100,000 copies | Unacceptable |

Having adhered silica fine particles treated with a homo- or copolymer having a quaternary ammonium salt structure, the positively chargeable electrophotographic toner according to the present invention reveals satisfactory effects produced by silica fine particles on improvement of fluidity in consistency with the effects of the homo- or copolymer having a quaternary ammonium salt structure on improvements of positive chargeability and environmental stability as apparently proved in Examples in view of Comparative Examples.

While the invention has been described in detail and with reference to specific embodiments thereof, it will be apparent to one skilled in the art that various changes and modifications can be made therein without departing from the spirit and scope thereof.

What is claimed is:

1. A positively chargeable electrophotographic toner which is prepared by adding to toner particles silica fine particles having been surface treated with a homo- or copolymer comprising, as a monomer component, a dialkylaminoalkyl acrylate or a dialkylaminoalkyl methacrylate in the form of a quaternary ammonium salt.

2. A positively chargeable electrophotographic toner as claimed in claim 1, wherein said silica fine particles have a particle diameter of not more than 40 nm.

3. A positively chargeable electrophotographic toner as claimed in claim 1, wherein said silica fine particles have a particle diameter of 0.1 to 20 nm.

4. A positively chargeable electrophotographic toner as claimed in claim 1, wherein said silica fine particles have a particle diameter of 3 to 16 nm.

5. A positively chargeable electrophotographic toner as claimed in claim 1, wherein the surface of said silica fine particles to be treated is rendered hydrophobic.

6. A positively chargeable electrophotographic toner as claimed in claim 1, wherein the homo- or copolymer has a weight-average molecular weight of 1,000 to 20,000.

7. A positively chargeable electrophotographic toner as claimed in claim 1, wherein the homo- or copolymer has a weight-average molecular weight of 2,000 to 10,000.

8. A positively chargeable electrophotographic toner as claimed in claim 1, wherein the homo- or copolymer is used in an amount of from 0.1 to 300 % by weight based on said silica fine particles.

9. A positively chargeable electrophotographic toner as claimed in claim 1, wherein the homo- or copolymer is used in an amount of from 0.5 to 150 % by weight based on said silica fine particles.

10. A positively chargeable electrophotographic toner as claimed in claim 1, wherein the toner particles have an average particle size of from 3 to 20 μm.

* * * * *